US010207391B2

(12) United States Patent
Rhodes et al.

(10) Patent No.: US 10,207,391 B2
(45) Date of Patent: Feb. 19, 2019

(54) DRY ICE PARTS FINISHING SYSTEM

(71) Applicants: Robin A. Rhodes, Worcester, MA (US); Bryce J. Trani, Shrewsbury, MA (US)

(72) Inventors: Robin A. Rhodes, Worcester, MA (US); Bryce J. Trani, Shrewsbury, MA (US)

( * ) Notice: Subject to any disclaimer, the term of this patent is extended or adjusted under 35 U.S.C. 154(b) by 13 days.

(21) Appl. No.: 15/494,462

(22) Filed: Apr. 22, 2017

(65) Prior Publication Data

US 2017/0312885 A1 Nov. 2, 2017

Related U.S. Application Data

(60) Provisional application No. 62/329,618, filed on Apr. 29, 2016.

(51) Int. Cl.

| | |
|---|---|
| ***B24C 1/00*** | (2006.01) |
| ***B24C 1/08*** | (2006.01) |
| ***B24C 3/28*** | (2006.01) |
| ***B24C 3/26*** | (2006.01) |

(52) U.S. Cl.

CPC ..... *B24C 1/003* (2013.01); *B24C 1/00* (2013.01); *B24C 1/08* (2013.01); *B24C 1/083* (2013.01); *B24C 3/26* (2013.01); *B24C 3/28* (2013.01)

(58) Field of Classification Search

CPC .. B24C 1/00; B24C 1/003; B24C 1/08; B24C 1/083; B24C 3/26; B24C 3/28

USPC ..... 451/39, 40, 85, 89

See application file for complete search history.

(56) References Cited

U.S. PATENT DOCUMENTS

| | | | | | |
|---|---|---|---|---|---|
| 3,160,993 | A * | 12/1964 | McCormick, Jr. | B24C 3/263 | 451/3 |
| 3,378,959 | A * | 4/1968 | McCormick, Jr. | B24C 3/26 | 451/3 |
| 3,702,519 | A * | 11/1972 | Rice | B24C 1/003 | 451/29 |
| 4,355,488 | A * | 10/1982 | Schmitz | B24C 3/083 | 451/38 |
| 4,648,214 | A * | 3/1987 | Brull | B24C 3/263 | 451/3 |
| 5,063,015 | A * | 11/1991 | Lloyd | B24C 1/003 | 264/161 |
| 2016/0279836 | A1* | 9/2016 | Schmand | B24C 1/006 | |

FOREIGN PATENT DOCUMENTS

| | | | | |
|---|---|---|---|---|
| DE | 102005012377 | * | 9/2006 | B24C 11/00 |

* cited by examiner

*Primary Examiner* — Eileen P Morgan

(74) *Attorney, Agent, or Firm* — ISUS Intellectual Property PLLC

(57) ABSTRACT

Apparatus for treating parts to remove imperfections in the parts includes: a chamber; a rotatable basket within the chamber; a source of liquified cold fluid; a source of dry ice particles; a programmed controller to control rotation of the basket, activation of the liquified cold fluid, cycle times and activation of the dry ice particles. The controller is programmed to activate rotation of the rotatable basket, activate the source of liquified cold fluid and activate the dry ice particles to treat parts in the rotatable basket.

8 Claims, 3 Drawing Sheets

DRY ICE PARTS FINISHING SYSTEM

RELATED APPLICATIONS

The present application relates to and claims priority to U.S. Provisional Application No. 62/329,618, filed Apr. 29, 2016, the entire contents of which is herein incorporated by reference.

SPECIFICATION/FIELD OF INVENTION

The present invention relates to a system and methodology for finishing parts or components that are manufactured.

BACKGROUND

After manufacture, many parts and components require additional finishing work to further enhance the surface finish of the parts. Examples of this include removing imperfections from a subtractive manufacturing process, (e.g. CNC or other machine burrs and imperfections, caused by a variety of cutting methods; parting line and other flash from molding or forming, etc.). The industry uses a number of generally accepted techniques for polishing or finishing these parts, to remove burrs and mold flash, etc. that include vibratory bowls, tumbling operations, blasting with different types of traditional media (e.g. plastic pellet, steel, shot, soda ash, abrasives, etc.). Further desirable finishing attributes may include surface finish, surface color, surface texture, surface cleanliness, etc. Consequently, the finishing work can be applicable to parts that are manufactured using additive techniques (e.g. 3D printing.)

One known technique used in this finishing work involves the processing of a batch of parts with traditional media that is recovered and reused (for continual blasting in an automated fashion) while the parts are in a frozen state in a chamber that is cooled with liquid nitrogen. This is generally referred to "Cryogenic Deflashing and/or Deburring". The parts may be placed in a perforated drum which itself is rotated about an axis. The parts to be treated and the traditional media which will treat these parts may be placed in the rotating drum. The interaction of the traditional media and the parts will act to remove burrs, flash, etc. The traditional media may be of a type that can be recycled and reused during the process, but a problem with this technique is that the parts, once processed, will likely need to be "cleaned" to remove all traces of the traditional media which may be harmful to the parts after processing. Since the traditional media itself may be very much smaller than the parts, traces may remain after the process has been completed. A number of companies produce such devices, including in no special order of presentation: C.D.S. Inc, C S P Cryomatic and Leonard Enterprises, Inc.

Another technique that is occasionally used involves the manual blasting of individual parts with a stream of dry ice particles to remove undesired characteristics of the part, such as burrs or flash, as mentioned above. In this technique, the part and the dry ice delivery systems are manipulated so that the spray pattern of dry ice is presented to the areas of the part that require the finishing process. This is generally referred to as "Dry Ice Blasting/Blast Cleaning or CO2 Cleaning/Blasting". Machines are commercially available which will present dry ice particles that are generally propelled by compressed air and are then "blasted" against a part. A similar technique shoots CO2 liquid (or gas) through a suitable nozzle system to cause the CO2 to change state and solidify so that it is projected (or shot) at the parts to be treated. One downside of this technique is that it is not suitable for large scale (or batch) processing of parts. A number of companies already manufacture and distribute such "ice blasting" devices, including Cold Jet, LLC which utilizes dry ice as the delivery medium and Cool Clean Technologies, LLC which utilizes a tank of liquid CO2 as the delivery medium.

There are "pros" and "cons" to each of the foregoing methods. These include, in connection with the cryogenic deflashing technique:

Pros
- Batch processing of parts.
- Computer programmed to eliminate human variables.
- Deburring/deflashing can be accomplished on almost all materials due to the cryogenic temperature inside the parts chamber that support the achievement of glass transition temperature (Tg) for effective deburring/deflashing.

Cons
- Uses traditional media which can become trapped in the geometry of parts.
- Exposes parts to traditional media that may bring undesirable reactions/potential reactions (e.g. PBA).
- Traditional media is often attracted to the part surfaces via ESD, water tension or other mechanisms resulting in parts that are "contaminated" with residual media.
- Traditional media can be abrasive and damage thin surface or fragile parts For the dry ice blasting technique, the "pros" and "cons" are as follows:

Pros
- Uses dry ice that is considered to be a non-abrasive media
- Dry Ice sublimates without leaving any residual media
- Dry Ice is non-toxic and does not contain harmful chemicals or pollutants, etc.
- Dry Ice does not get stuck, attach to or lodge in the parts geometry or on the surfaces
- Has ability to use micro-particle sized ice finish (e.g. clean, deburr, deflash, etc.) a wide range of parts, including parts that are micro sized and made with delicate materials.
- Manipulation of parts and or delivery system permits focus to specific areas
- Can be used as a cleaning operation to remove surface contamination or prep for secondary processes Cons
- Cannot be used to deburr/deflash parts in a batch
- Burrs and flash can be difficult to remove when parts are at room temperature.
- Operator dependent process that is inherently unrepeatable/programmable resulting in variable quality and results
- Safety of the operator cannot be assured because parts and ice stream are not contained in an enclosure.

It is to these shortcomings and "cons" in present day techniques that the present invention is directed to remedy.

SUMMARY OF THE PRESENT INVENTION

In an aspect, an apparatus for treating parts to remove imperfections in the parts includes a chamber; a rotatable basket within the chamber; a source of liquified cold fluid; a source of dry ice particles; a programmed controller to control rotation of the basket, activation of the liquified cold fluid, and activation of the dry ice particles. The controller is programmed to activate rotation of the rotatable basket, activate the source of liquified cold fluid and activate the dry ice particles to treat parts in the rotatable basket.

In another aspect, the source of liquified cold fluid is selected from one or more of: liquid nitrogen or liquid CO2 and the source of dry ice particles is one or more of: dry ice blocks or liquified CO2.

In a further aspect, the programmable controller first activates the rotatable basket, then activates the source of liquified cold fluid to deliver the cold fluid into the chamber and then activates the source of dry ice particles to cause the dry ice particles to impinge on and treat the parts within the basket. The impingement of dry ice particles on the parts causes the removal of one or more of: flash or burrs on the parts.

In yet another aspect, the apparatus further includes one or more nozzles operatively connected to the source of dry ice particles; the one or more nozzles are positioned to direct the dry ice particles into the interior volume of the basket. The one or more nozzles may be mounted into a wall of the chamber. The rotatable basket may be open in at least one end thereof, rotates about an axis of rotation, and the one or more nozzles are positioned to direct dry ice particles into the open end of the basket substantially along the axis of rotation.

In another aspect, a method for treating parts to remove imperfections in the parts includes:

providing a chamber; providing a rotatable basket within the chamber; providing parts whose imperfections are to be removed in the basket; providing a source of liquified cold fluid; providing a source of dry ice particles; providing a programmed controller to control rotation of the basket, activation of the liquified cold fluid, and activation of the dry ice particles; the method further includes the controller activating rotation of the rotatable basket, activating the source of liquified cold fluid and activating the dry ice particles to treat parts in the rotatable basket.

In a further aspect, the sequence of activation is: rotation of the basket, activation of the source of liquified cold fluid and activation of the dry ice particles. In addition, the sequence of activation is: rotation of the basket, activation of the source of dry ice particles and activation of the liquified cold fluid.

In yet a further aspect, the dry ice particles impinge on the parts and remove one or more of: flash, burrs or other imperfections. Also, the dry ice particles sublimate after impinging on the parts and the method is performed without the presence of traditional media.

DETAILED DESCRIPTION OF THE PRESENT INVENTION

The present invention combines elements of both the "Cryogenic Deflashing and Deburring" method and the "Dry Ice Blasting" method by combining the beneficial elements of both into a new machine and technique that brings significant advantages over either prior method independently. By combining the two techniques, batch processing of large amounts of parts may be achieved, while at the same time the traditional media is eliminated. The stream of dry ice particles, once they impact on the part or parts, sublimate and turn to gas (vapor), thus leaving no residue as is the case with the types of traditional media discussed herein.

The present invention provides that the parts that require finishing may be placed into an insulated chamber (or compartment) that is equipped with a mechanized method for tumbling or otherwise presenting the parts to a blast stream of dry ice and that said chamber (or cabinet) be capable of achieving and maintaining a preprogrammed temperature in a closed and contained environment.

Temperature may be controlled and maintained by closed loop automated monitoring. The blasting stream may be in a permanent, semi-permanent (e.g. adjustable) or variable (over a random or preprogrammed pattern) location and may involve more than one source of dry ice delivery (e.g. opposite sides, multiple spray patterns, fixed and variable, etc.).

The pattern of dry ice may be adjustable as to the quantity of ice delivered, the size of the dry ice particles, the source of the dry ice, (e.g. liquid CO2 or solid CO2), as well as in its density of coverage and the pressure of application.

In certain applications, control of other factors (beside temperature) in the chamber may be incorporated, such as the air pressure, air flow direction and volume, air input, air input temperature, exhaust flow, exhaust location, etc.

Figure 1:
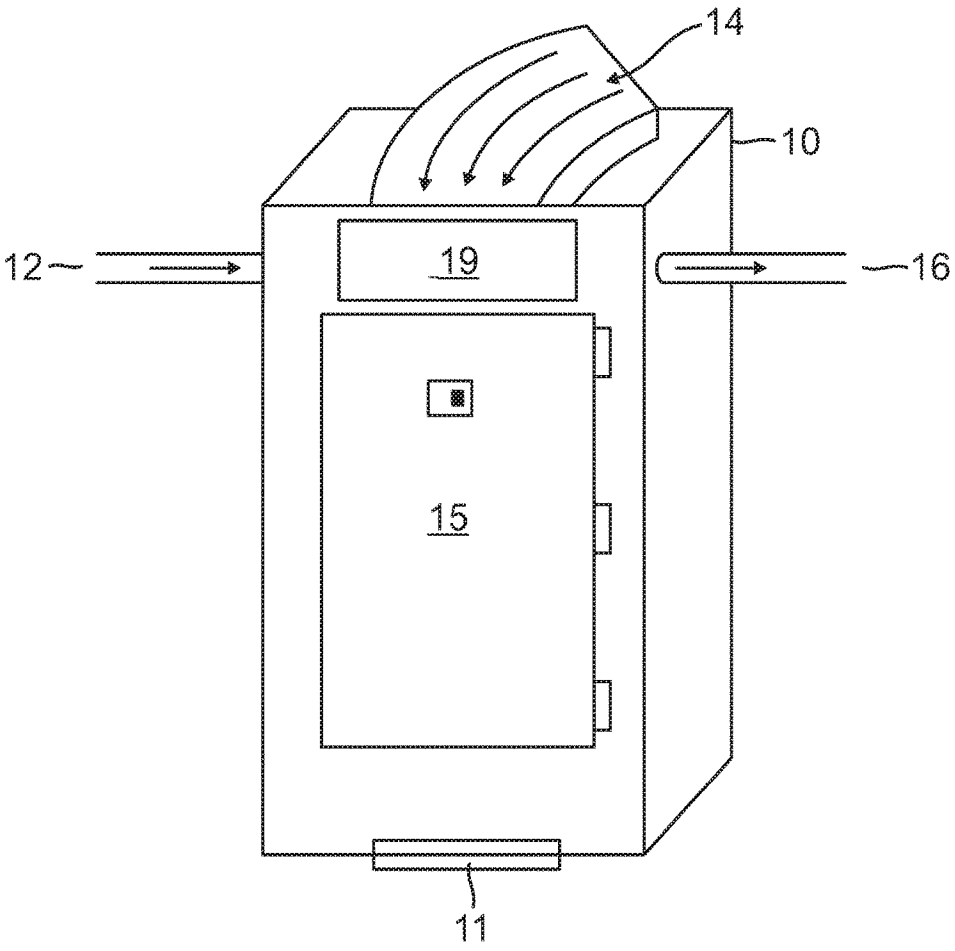
FIG. 1 illustrates a deflash chamber which incorporates the devices of the present invention.

Turning now to the drawing figures, FIG. 1 illustrates a perspective block view of a chamber which may be used in the practice of the present invention. The chamber may be an insulated chamber 10 which receives two cryogenic inputs: one (12) being a low temperature input in the form of liquid nitrogen (or other cryogen, such as CO2) which maintains the temperature of the parts being treated in a very cold condition or atmosphere, the other (14) being dry ice particles (which may be of uniform or variable sizes) that originate from either a solid source of dry ice or from a liquid CO2 source that changes state from a liquid or gas into a solid stream of dry ice particles. While both sources are shown mounted in the upper part of the chamber 10, it is to be understood that they may be mounted as desired. A more accurate view of a preferred embodiment is illustrated in FIG. 2 and described in detail below.

An exhaust system 16 removes gases after processing within the chamber 10. A programmable controller 17 may be incorporated to control such parameters as rates of turn of the perforated rotating drum (described above and below in greater detail in reference to FIG. 2) containing the parts to be treated, the quantity of liquid nitrogen to be introduced and the timing and quantity of dry ice impacting the parts to be treated. A door 15 may be provided to allow access to the interior of the chamber 10 and a drain 11 may be provided to drain any liquid residue from operations within the device 10.

Figure 2:
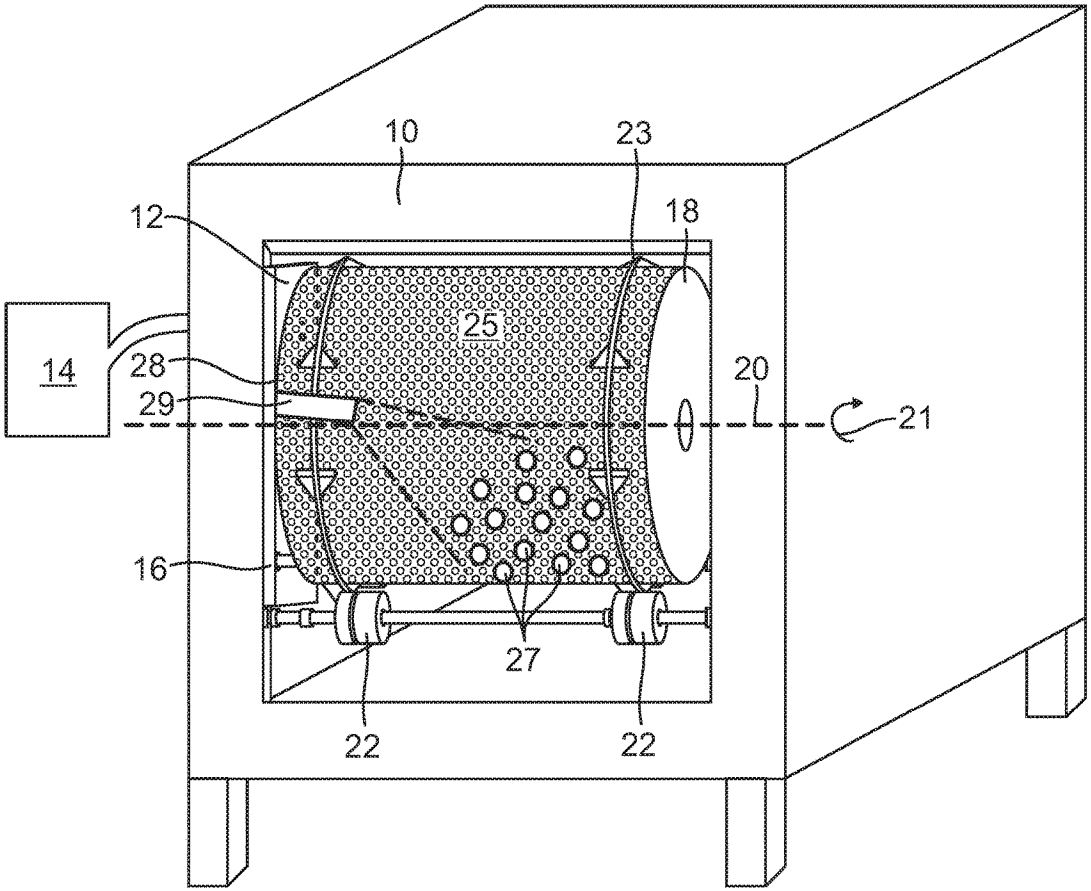
FIG. 2 illustrates an interior view of the chamber of FIG. 1 illustrating the structure and operation of the present invention.

Turning now to FIG. 2, this figure are further detailed representations of the chamber 10 from FIG. 1 but with the access door 15 being in an open state. FIG. 2 shows a drum or mesh basket 18 mounted in the chamber 10 in which the drum may be made to rotate about axis 20 in direction 21, although it could also rotate in the opposite direction. The drum or mesh basket 18 may be driven to rotate by a suitable motor and the basket may be supported on rollers 22 mounted within the chamber and engage slotted rails 23, although the present invention is not limited to this just-described support and rotation system. The drum is perforated as seen in reference numeral 25 to allow nitrogen liquid turned gas to permeate the rotating drum or basket and any parts 27 contained therein. The parts 27 to be treated are placed in the interior of the drum/basket. The permeations or holes in the mesh basket may be suitably sized such that nitrogen may permeate the basket and the parts therein, but also be small enough so that the parts being treated do not fall through the holes. Another consideration is to construct the holes such that burrs, flash and other imperfections which are removed from the parts may fall to the bottom of the chamber for removal. While it cannot be seen in FIG. 2, at least one "end" of the drum/basket is "open" as will be explained in connection with FIG. 3.

Further, in FIG. 2 is shown the dry ice supply 14. The dry ice supply, as mentioned, may be a known device which crushes or slices a dry ice block or dry ice cubes to a predetermined size and then "shoots" the particles thus formed through conduit 19 and through to nozzle 29. It is to be understood that nozzle 29 may be of any suitable size or material to deliver the particles. Further, multiple nozzles may be employed depending on the coverage desired, the particular parts to be treated, etc. The nozzle or nozzles may be adjustable in direction to suit the particular set-up and parts types to be treated, or may even be movable so that the nozzles(s) and thus the direction(s) of dry ice flow may be adjusted and varied to suit the particular treatment regimen. It is also to be understood that instead of the dry ice device that employs dry ice, a CO2 canister may be provided in the same manner to conduit 19 and nozzle 29.

The nozzle 29 is shown in FIG. 2 as mounted to enter an aperture in the chamber 10. The nozzle may be designed to enter the chamber but not into the basket or may be designed to project into the basket itself, it being understood that the drum/basket is at least partially open so that it may receive the nozzle 29 or at least a spray of dry ice particles emanating from the nozzle into the drum/basket.

Figure 3:
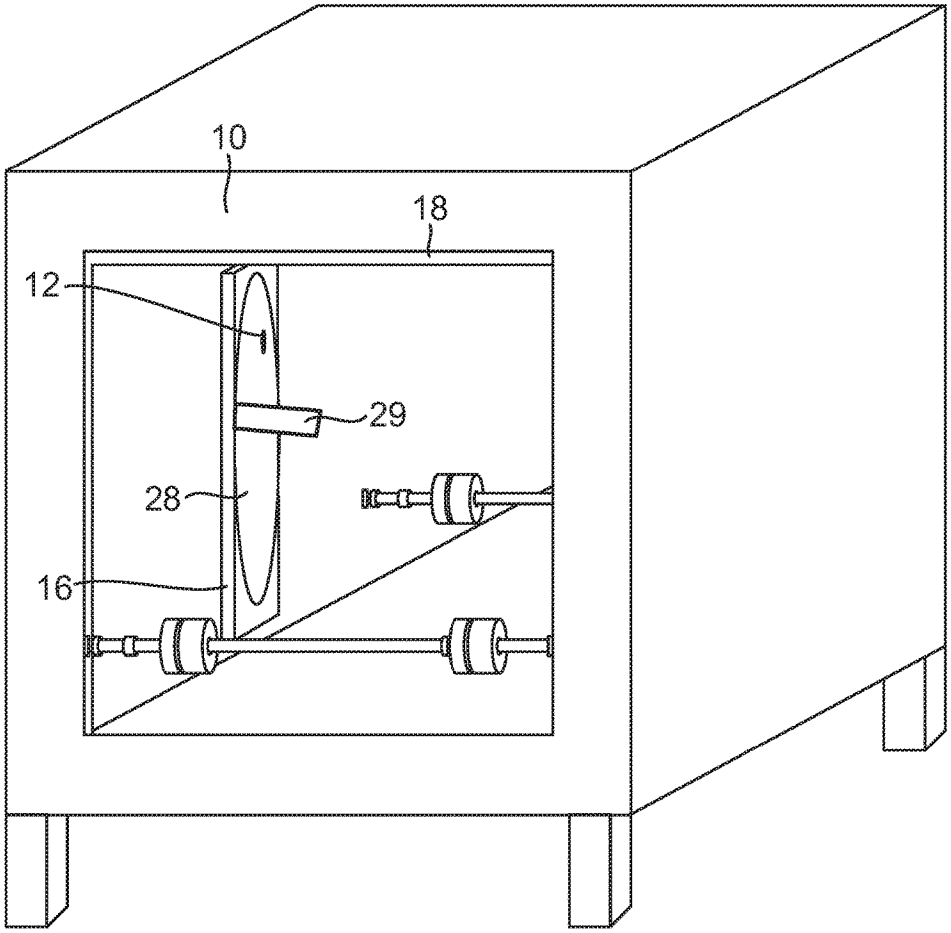
FIG. 3 illustrates an interior view of one wall of the chamber with parts of the device of the present invention shown.

FIG. 3 is similar to FIG. 2 except that the basket has been removed to show the interior portions of the chamber 10 of the present invention. Liquid nitrogen (or another suitable cryogen) may be delivered through access 12. The drum/basket may be rotated by way of a basket drive (not shown) which is in turn associated with a motor (also not shown). A dry ice entrance 28 is cut through the chamber wall. The dry ice entrance 28 receives the nozzle 29 connected to a source of dry ice particles. Because, as mentioned, the "end" of the drum/basket is "open", the dry ice particles "shot" or "blasted" from the nozzle 29 will impinge on the moving parts in the drum/basket and remove burrs, flash and other imperfections in or on the parts, which burrs, flash and other imperfections will fall through the holes or mesh in the basket and to the bottom of the chamber.

Thus, in operation, parts to be treated may be placed into the chamber 10 and the drum/basket 18, and the basket rotated under the control of the programmable controller 17. Then, the source of liquid nitrogen 12 may be activated so that a flow of liquid nitrogen (which will morph to a very cold gas) will envelope the parts 27 rotating in the basket 18. After that the dry ice supply 14 may be activated, again under the control of the programmable controller 17, so that dry ice particles will impinge on the parts 27 and thus remove burrs, flash or other imperfections from the parts. The burrs, flash or other imperfections will be expected to fall through openings in the basket and all to the bottom of the chamber to be removed at some juncture, thus leaving the parts free of burrs, flash or other imperfections but also the traditional media of the prior art devices. It is to be understood that the sequence of activating rotation of the basket, activating the liquid nitrogen source and activating the dry ice source may be sequenced in any suitable manner or order of activation.

Once the operation has been completed, the parts are removed. No cleaning of media from the parts is required with the present invention. While FIGS. 2 and 3 show the drum/basket horizontally disposed, it is to be understood that it may be disposed at any other suitable angle so long as the nozzle is "aimed" at the open end of the drum/barrel so that the full effects of the dry ice blasting may be applied to the parts.

What we claim is:

1. Apparatus for treating parts in a cryogenic chamber to remove imperfections in the parts comprising:

a cryogenic chamber;

a rotatable basket within the chamber having an interior volume for holding one or more parts to be treated;

a source of a cold gas;

a source of dry ice particles;

a programmed controller to control rotation of the basket, activation of the cold gas, and activation of the dry ice particles;

wherein the controller is sequentially programmed to activate rotation of the rotatable basket, then activate the source of cold gas to chill the one or more parts to a desired low temperature and then activate the dry ice particles to cause the dry ice particles to impinge on and to treat the one or more parts in the rotatable basket;

wherein the impingement of dry ice particles on the parts causes the removal of one or more of: flash, burrs or other imperfections on the one or more parts;

further comprising one or more nozzles operatively connected to the source of dry ice particles, and wherein the one or more nozzles are positioned to direct the dry ice particles into the interior volume of the basket such that the activation of the rotatable basket, the activation of the source of cold gas and the activation of the dry ice particles takes place all within the cryogenic chamber.

2. The apparatus of claim 1, wherein the source of the cold gas is derived from one or more of: liquid nitrogen or liquid CO2 that have morphed into a gaseous state of gaseous nitrogen or gaseous CO2.

3. The apparatus of claim 1, wherein the source of dry ice particles is one or more of: dry ice blocks that have been ground into fine particles or liquified CO2 that has been turned into solid particles.

4. The apparatus of claim 1, wherein the one or more nozzles is mounted into a wall of the chamber.

5. The apparatus of claim 1, wherein the rotatable basket is open in at least one end thereof, rotates about an axis of rotation, and the one or more nozzles are positioned to direct dry ice particles into the open end of the basket substantially along the axis of rotation.

6. A method for treating one or more parts to remove imperfections in the one or more parts comprising:

providing a cryogenic chamber;

providing a rotatable basket within the chamber having an interior volume for holding the one or more parts;

providing the one or more parts with imperfections to be removed in the basket;

providing a source of a cold gas;

providing a source of dry ice particles;

providing a programmed controller to control rotation of the basket, activation of the cold gas, and activation of the dry ice particles; and, wherein the method comprises the controller sequentially activating rotation of the rotatable basket, then activating the source of cold gas to chill the one or more parts to a desired low temperature and then activating the dry ice particles to treat the one or more parts in the rotatable basket;

wherein the impingement of dry ice particles on the parts causes the removal of one or more of: flash, burrs or other imperfections on the one or more parts;

further comprising one or more nozzles operatively connected to the source of dry ice particles, and wherein the one or more nozzles are positioned to direct the dry ice particles into the interior volume of the basket such that the activation of the rotatable basket, the activation of the source of cold gas and the activation of the dry ice particles takes place all within the cryogenic chamber.

7. The method of claim 6, wherein the dry ice particles sublimate after impinging on the parts.

8. The method of claim 6, wherein the method is performed without the presence of traditional media.

* * * * *